US006691492B2

(12) United States Patent
Gamberini

(10) Patent No.: US 6,691,492 B2
(45) Date of Patent: Feb. 17, 2004

(54) ELEVATOR DEVICE IN MACHINES FOR FORMING PACKS OF ROLLS

(76) Inventor: Gianluiigi Gamberini, Via Carrati 12, Bologna (IT)

( * ) Notice: Subject to any disclaimer, the term of this patent is extended or adjusted under 35 U.S.C. 154(b) by 0 days.

(21) Appl. No.: 09/989,588

(22) Filed: Nov. 20, 2001

(65) Prior Publication Data

US 2002/0059778 A1 May 23, 2002

(51) Int. Cl.[7] ..... B65B 11/22
(52) U.S. Cl. ..... 53/230; 53/232
(58) Field of Search ..... 53/228, 230, 528, 53/586, 231, 232

(56) References Cited

U.S. PATENT DOCUMENTS 1,085,260 A * 1/1914 Holden ..... 53/230
1,816,085 A * 7/1931 Langhammer ..... 53/231
1,873,060 A * 8/1932 Smith ..... 53/230
3,287,880 A * 11/1966 Hansel ..... 53/228
3,683,586 A * 8/1972 Duckhinsky et al. ..... 53/228
3,855,758 A * 12/1974 Walter et al. ..... 53/230
4,137,691 A * 2/1979 Takahashi ..... 53/230
4,208,854 A * 6/1980 Seragnoli ..... 53/575
4,813,211 A * 3/1989 Treiber ..... 53/556
5,406,774 A * 4/1995 Dodge ..... 53/230

* cited by examiner

*Primary Examiner*—John Sipos
(74) *Attorney, Agent, or Firm*—William J. Sapone; Coleman Sudol Sapone, P.C.

(57) ABSTRACT

An elevator device in a machine for forming packs of rolls includes an auxiliary plate member, situated between wrapping sheet folders and a constraining plate of a conveying line. The auxiliary plate member moves vertically between a lower end position near and above the folders, and an upper end position in alignment with the constraining plate. When an elevation plate is raised to push a group of rolls partially wrapped with a wrapping sheet against the constraining plate, the auxiliary plate member keeps the rolls and the sheet firm and is moved synchronously with the plate thus carrying the group of rolls and the sheet upwards until they are received within holding means of a conveying line.

8 Claims, 3 Drawing Sheets

ELEVATOR DEVICE IN MACHINES FOR FORMING PACKS OF ROLLS

TECHNICAL FIELD

The present invention relates to the technical field concerning automatic machines for forming packs of rolls, e.g. toilet paper rolls, tissue paper rolls, etc., arranged in groups or rows of one or more layers, by wrapping each pack with a protective wrapping sheet, e.g. polythene.

More precisely, the present invention relates to an elevator device mounted on machines for forming the packs of rolls, in the working station for initial wrapping step of the packs.

DESCRIPTION OF THE PRIOR ART

Automatic machines for forming packs of rolls, e.g. toilet paper rolls, tissue paper rolls, etc., include a working station for the initial wrapping step of the packs of rolls being formed.

The initial wrapping station, where a provisional wrapping is firstly applied to the pack of rolls, is situated between a substantially horizontal line for feeding the rolls to be arranged in groups to be packaged, and a substantially horizontal line conveying the packs being prepared away, situated above the rolls feeding line.

The working station for initial wrapping of the packs of rolls is aimed at partially wrapping the upper side of the packs with a protective sheet, and at transferring the pack with the protective sheet from the feeding line to the conveying line. The above working station includes substantially an elevator device equipped with an elevating plate, which reciprocates vertically from a lower end position, situated at the level of the rolls feeding line, and an upper end position, defined by positioning of the partially wrapped packs at a level just beneath a constraining plate, or a plurality of bars, of the conveying line.

While dwelling at the lower end position, the elevating plate of the above mentioned elevator device receives a pack of rolls to be packaged from the rolls feeding line and then raises the pack of rolls until it hits the protective sheet, kept stretched by appropriate means.

Consequently, the elevator device moves the rolls partially wrapped by the sheet into a guiding channel, where the rolls are conveyed, until the group passes through the aperture of means for folding the protective sheet, which are in open configuration and situated at the outlet of the conveying channel.

After having reached the upper end position, the elevator device places the rolls and the sheet against the constraining plate and within holding arms of the conveying line.

Then, the elevator device lowers the plate to the lower end position, to receive another pack of rolls to be packaged, while the folding means, moved to the closed configuration, fold the wrapping sheet under the pack of rolls.

Then, the conveying line carries the open-ended wrapped pack of rolls to the working stations for completion of the wrapping and sealing of the pack.

At present, in order to increase the production rate by increasing the number of packs obtained in the same time interval, the elevator device has been operated with always higher operation speed.

This results in considerable functional problems and disadvantages, because the high speed during the raising of the pack of rolls to be packaged makes the pack detach from the plate and bounce against the constraining plate of the conveying line, situated above, before the plate reaches its upper end position.

Thus, during the critical step of initial wrapping the pack of rolls, the rolls bounce continuously between the plate and the constraining plate of the conveying line.

As a result, the wrapping of the pack of rolls to be packaged becomes ruffled, because the rolls bounce continuously and detach from the sheet, and consequently they do not maintain the best configuration.

Consequently, the protective sheet is no longer smoothly applied and does not adhere perfectly to the pack of rolls being packaged and the rolls will be loosely packed.

In order to avoid this disadvantage, the operating speed of the elevator device has been controlled accurately.

In particular, the speed of the plate has been increased gradually, during the first part of the stroke, so as to prevent the packs of rolls from detaching.

However, due to obvious mechanical-kinetic reasons, the speed must be gradually reduced during the final portion of the stroke to avoid too rapid damages to the mechanism caused by stops, which are too sudden with respect to the inertial masses involved.

Obviously, the speed control must be performed while maintaining at the same time a high production rate, and it should possibly increase the latter.

Attempts made in the prior art until now, have not been capable of performing an effective control of the rolls with operation speed higher than the speed actually obtained, because of constructive and dynamic difficulties, ensuring at the same time high and optimal production rates.

According to another attempt to avoid the movements of the group of rolls on the plate, the rolls were kept as much compressed as possible during the raising step.

This was aimed at creating a kind of friction on the walls of the pack of rolls contrary to the motion of the pack raising, e.g. by reducing the transversal dimension of the guiding channel.

However, the above contrary action reduces the risk of bouncing movements between the pack of rolls and the plate, but on the other side, it can cause some imperfections in the wrapping of the pack with the protective sheet.

Actually, the arrangement of the rolls in the packages obtained by the above method is often imperfect and consequently, the look of the packages is not attractive for the consumer.

SUMMARY OF THE INVENTION

The object of the present invention is to propose an elevator device in machines for forming packs of rolls, which avoids the above mentioned disadvantages.

More precisely, the main object of the present invention is to propose an elevator device, which avoids undesired bounces of the pack of rolls during its raising toward the conveying line and partial wrapping in a protective sheet.

Another object of the present invention is to propose an elevator device, which allows to maintain high production rate of the machine for forming packs of rolls and, at the same time, ensures high packaging quality.

The above mentioned objects are obtained, in accordance with the contents of the claims, by means of an elevator device in a machine for forming packs of rolls, the machine including:

a feeding line for feeding rolls;

a conveying line situated above said feeding line for carrying away packs of rolls already formed;

upper constraining means disposed along the conveying line;

holding means of said conveying line, for holding a group of rolls being packed; and an elevator device for taking the rolls from said feeding line to said conveying line, said elevator device including:

an elevation plate made to reciprocate vertically between a lower end position, situated at the level of said feeding line for receiving rolls from said feeding line thus forming a group of rolls on said elevation plate, and an upper end position, defined by positioning a group of rolls on said elevation plate at a level right below said constraining means;

a conveying channel for said group of rolls on said elevation plate, said conveying channel leading from said lower end position of said elevation plate up to said upper end position;

means for keeping a wrapping sheet spread crosswise at an intermediate point of said conveying channel, said wrapping sheet partially wrapping said group of rolls on said elevation plate;

an aperture made at top of said conveying channel;

folding means disposed right above said aperture for folding said wrapping sheet under said group of rolls on said elevation plate when said elevation plate is in said upper end position;

an auxiliary plate member, situated above said folding means and below said constraining means, said auxiliary plate member moving vertically between a position near and above said aperture, and a position in alignment with said constraining means of said conveying line, in step relation with operation of said elevation plate, for keeping said group of rolls on said elevation plate firm while said group of rolls is passing through said aperture to be placed within said holding means.

BRIEF DESCRIPTION OF THE DRAWINGS

The characteristic features of the present invention will be pointed out in the following description of a preferred, but not unique embodiment, with reference to the enclosed drawings, in which.

DETAILED DESCRIPTION OF THE INVENTION

Figure 1:
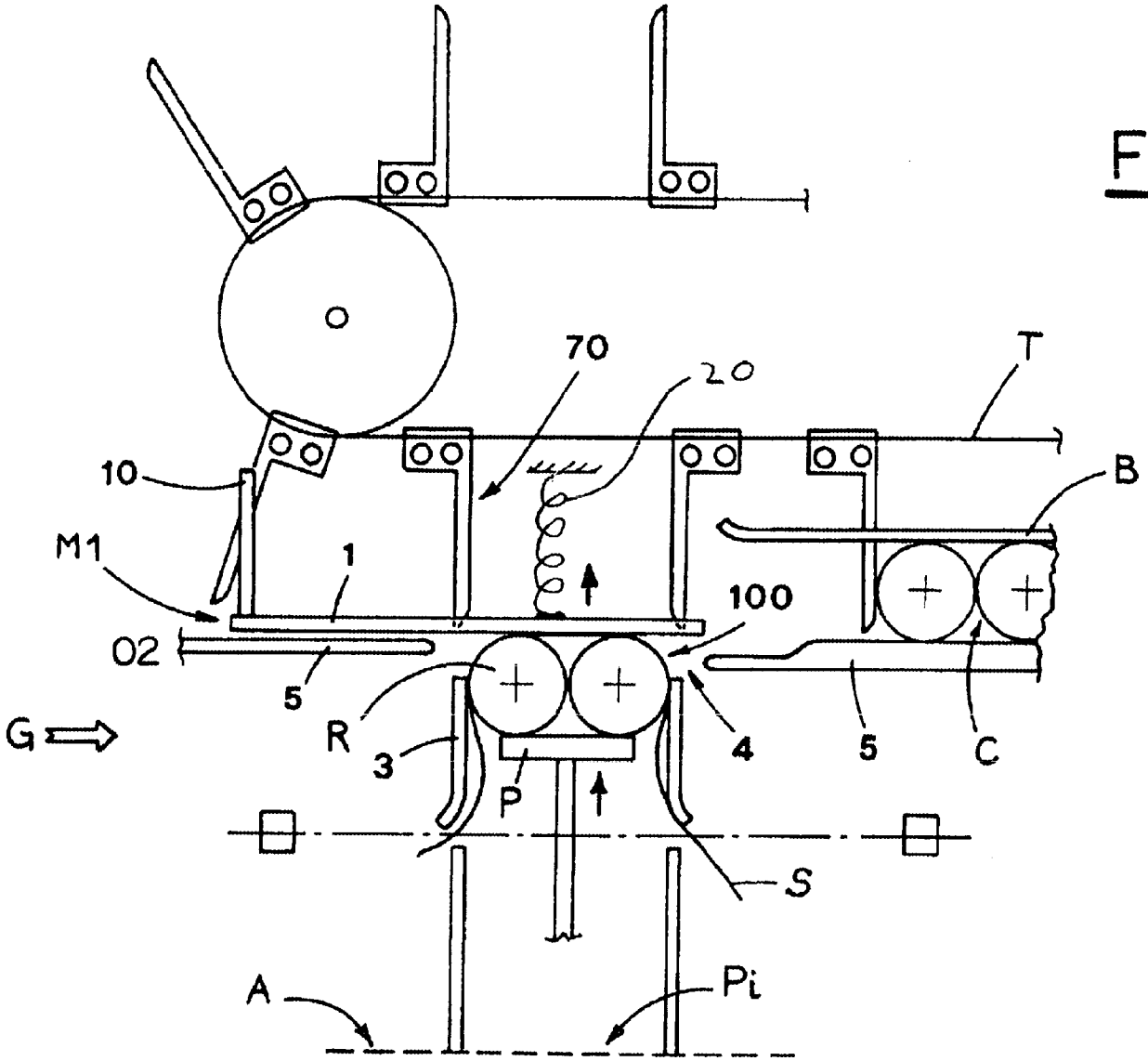
FIGS. 1, 2, 3, 4 and 5 are schematic front views of the elevator device in a machine for forming packs of rolls, proposed by the present invention, shown in subsequent different working configurations relative to the partial wrapping of a pack of rolls with a protective sheet.

With reference to the enclosed drawings, reference G indicates the elevator device in machines for forming packs of rolls R, proposed by the present invention.

The elevator device G is situated and acts between a substantially horizontal line A for feeding rolls R to be packaged in packs wrapped with a protective sheet S, e.g. polythene, and a conveying line T, situated above the feeding line A.

The elevator device G is aimed at receiving a group or pack 100 of rolls R, arranged in groups or rows of one or more layers, from the feeding line A and at bringing the received pack 100 to the conveying line T, in a way that the pack hits a sheet S, wrapping it partially, and passes through a vertical conveying channel 3, where the rolls are suitably guided and the sheet S is initially wrapped around the pack.

The conveying line T is equipped with pulling means 6, e.g. plurality of pairs of arms, which define seats 70 for receiving and conveying the packs 100 of rolls R on a supporting surface situated below and not shown, as known to those skilled in the art.

Along the conveying line T there is disposed a constraining plate B, or a plurality of bars, for keeping the packs 100 while being conveyed.

At an intermediate level between the feeding line A and a constraining plate B, and above the above mentioned conveying channel 3, there are located folding means 5 aligned with a sliding plane (not shown), which is parallel to the above mentioned constraining plate B.

The constraining plate B is associated to the conveying line T.

The folding means 5 move between an open configuration O2, in which they define a aperture 4 for the passage of the rolls 100 with the wrapping sheet S, raised by the elevator device G, and a closed configuration O1, in which they fold the wrapping sheet under the pack.

The elevator device G includes a elevating plate P, which is operated vertically by driving means (not shown), to reciprocate between a lower end position Pi and an upper end position Ps.

Figure 2:
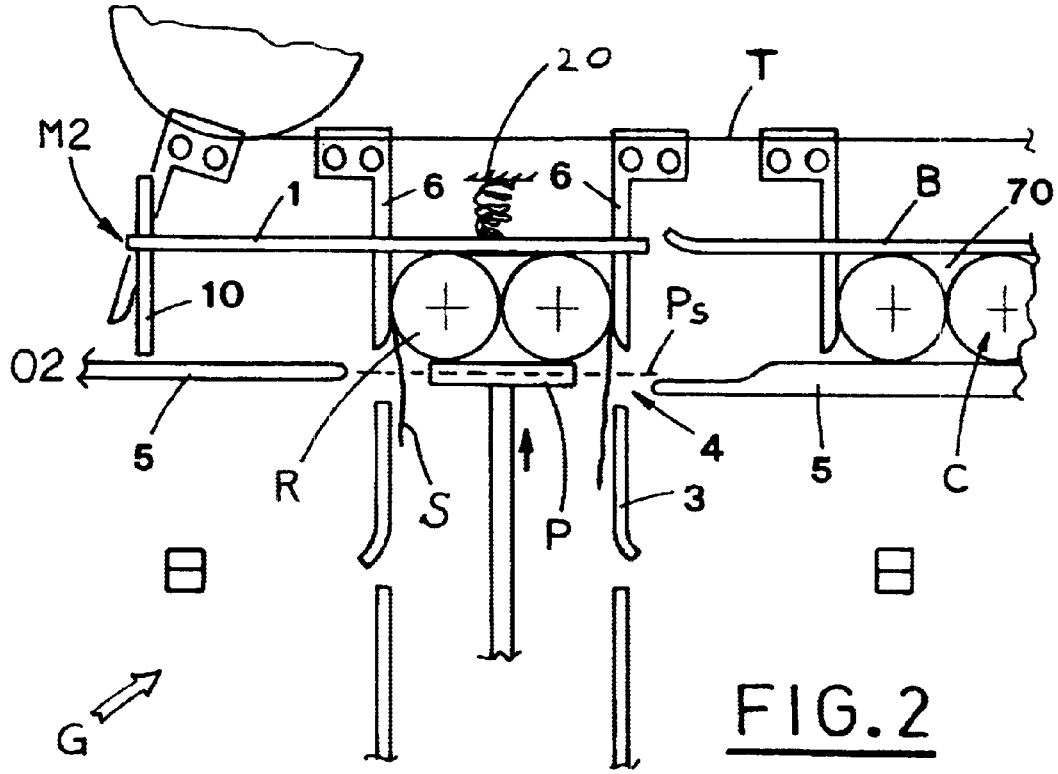

The lower end position Pi is defined by the positioning of the plate P at the level of the feeding line A (shown schematically in FIG. 1), while the upper end position Ps is defined by the positioning of the rolls 100 with the wrapping sheet S at the level of the constraining plate B, connected to the conveying line T (FIG. 2).

The elevator device G is equipped also with an auxiliary plate member 1, which is situated between the folding means 5 and the constraining plate B, parallel thereto.

The auxiliary plate member 1 is guided by at least one vertical arm 10 and operated by an actuator (not shown), or other mechanical means, to move vertically between a lower end position M1 and an upper end position M2. The actuator is controlled by the means driving the plate P.

The lower end position M1 is defined by the positioning of the auxiliary plate member 1 near and right above the folding means 5 (FIG. 1), while the upper end position M2 is defined by the alignment of the auxiliary plate member 1 with the constraining plate B (FIG. 2).

The auxiliary plate member 1 has the important task of stopping the rolls 100 with the wrapping sheet S, raised by the plate P, during the passage through the aperture 4 of the folding means 5 in open position O2 and keeps the rolls 100 with the wrapping sheet S until it is positioned in the holding means 6 of the conveying line T, thus avoiding any undesired relative motion with respect to the plate P.

In order to perform the above action, the auxiliary plate member 1 is operated by the relative actuator, e.g. in perfect synchrony with the plate P.

Moreover, the plane P is advantageously equipped with an elastic contrast spring system 20, which causes a yielding movement of the plate when the pack of rolls is raised toward the conveying line T.

The spring system can also perform another important task of contrasting possible misalignment of the rolls in the pack caused by the high raising speed of the plate, thus ensuring perfect wrapping of the rolls with the protective sheet.

Now, operation of the elevator device G, proposed by the present invention will be described briefly.

The cycle begins from, taken as an example in the description of the working steps of the elevator device G, the configuration shown in FIG. 1, in which the auxiliary plate member 1 is in the lower end position M1.

The plate P moves from its lower end position Pi to its upper end position Ps and raises the pack 100 of rolls R with the wrapping sheet S through the conveying channel 3 and carries them through the aperture 4 of the folding means 5 in open configuration O2.

During the passage through the aperture 4, the rolls 100 with the wrapping sheet S hit the auxiliary plate member 1 (FIG. 1), which is immediately operated, synchronously with the plate P, to rise toward its upper end position M2.

Consequently, the rolls 100 with the wrapping sheet S are kept firmly between the plate P and the auxiliary plate member 1, and no relative motions between the rolls and the plate P can occur.

In step relation with reaching of the upper end position Ps by the plate P, the auxiliary plate member 1 reaches its upper end position M2 and the rolls 100 with the wrapping sheet S are introduced in a seat 70 of the conveying line T (FIG. 2).

The cooperation between the plate P and the auxiliary plate member 1 allows the elevator device G to bring the group of rolls 100 with the wrapping sheet S to the conveying line T, at the same time maintaining the rolls firmly and the sheet wrapped around the rolls adhering thereto and stretched in a proper way.

Figure 3:
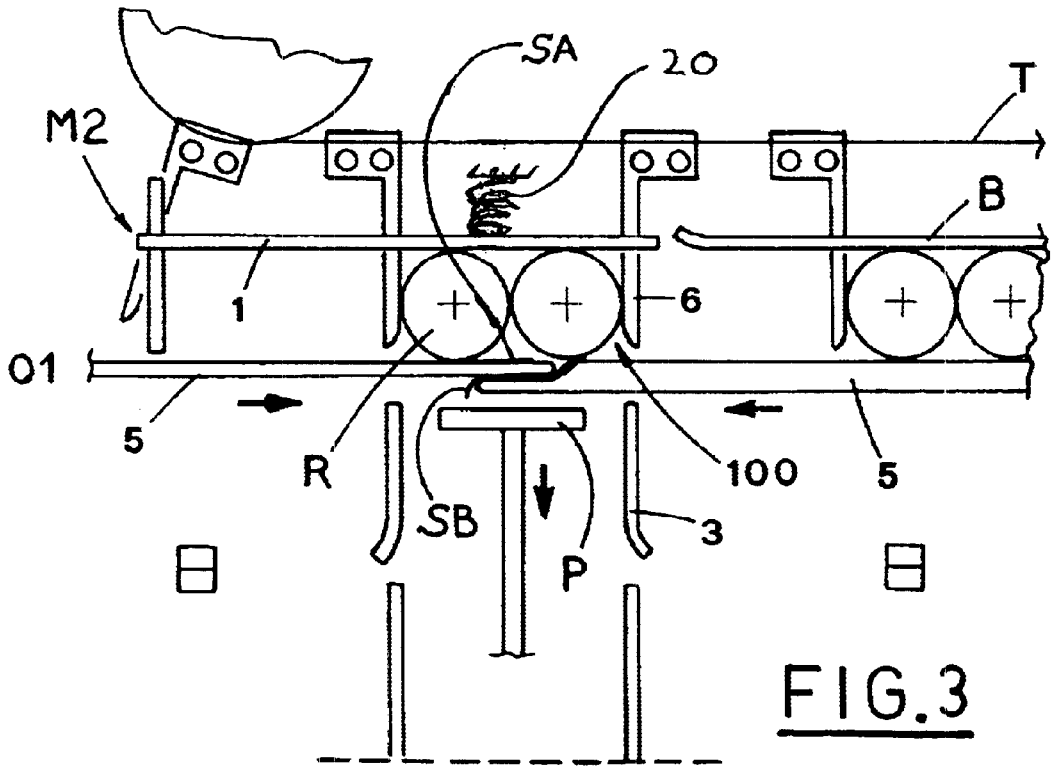

In time relation with the positioning of the group of rolls 100 with the wrapping sheet S in the seat 70, the plate P returns to its lower end position Pi and then the folding means 5 move to the closed configuration O1, to fold the edges SA, SB of the wrapping sheet under the pack 100 (FIG. 3).

Figure 4:
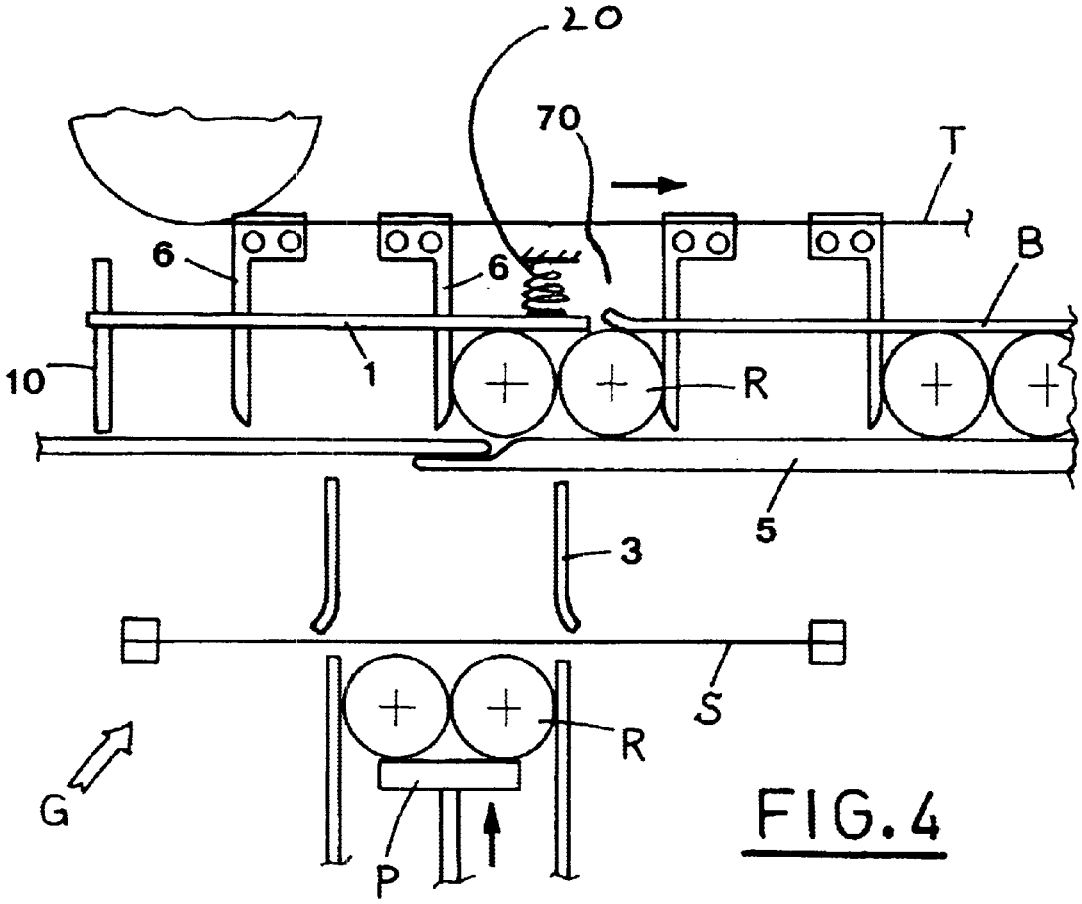

Afterwards, the conveying line T transfers the open-ended partially wrapped pack 100 of rolls R by one step, while the plate P, after having reached the lower end position Pi, receives a subsequent group of rolls R to be wrapped with a new sheet S (FIG. 4).

Figure 5:
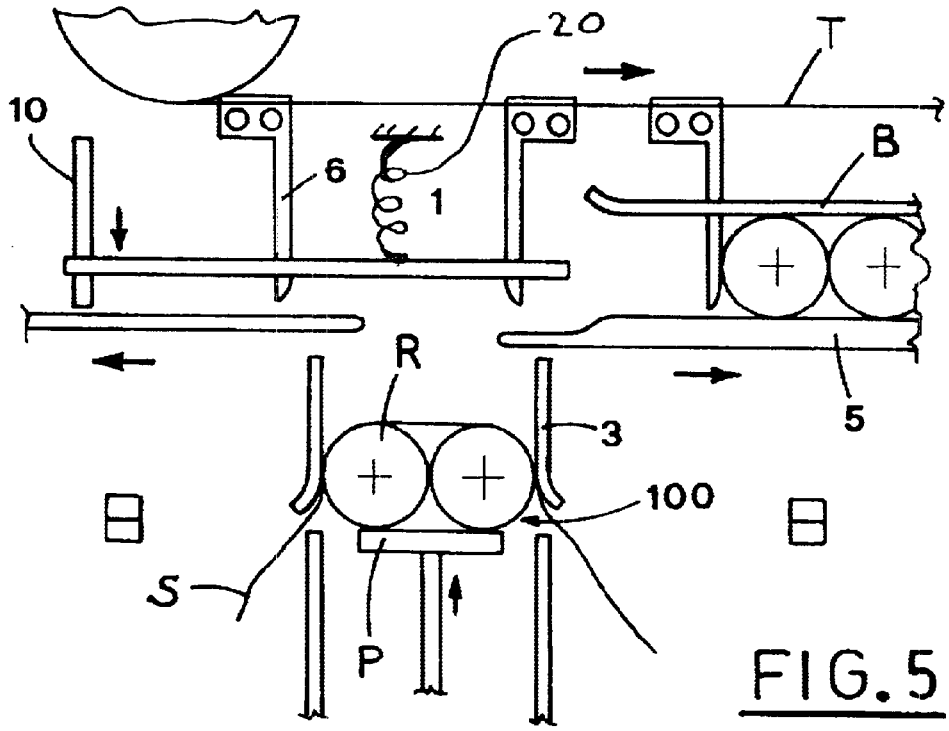

In phase relation with the one-step movement of the pack 100 of rolls R, partially wrapped with the sheet S, the folding means 5 are brought again to the open configuration O2, while the auxiliary plate member 1 returns to its lower end position M1 to constrain the subsequent pack of rolls R to be wrapped with the sheet S, which is being raised, in the meantime by the plate P and put into the conveying channel 3 (FIG. 5).

Therefore, it is obvious that the presence of the auxiliary plate member 1, operated in perfect synchrony with the plate P, allows advantageously to avoid undesired relative motions between the rolls of the pack and the plate P, during raising of the pack 100 to be wrapped with the protective sheet.

This advantageously allows to perfectly stretch the protective sheet and make it adhere to the rolls R, which is substantial to obtain packs which are perfect and perfectly sealed.

It is also to be pointed out that the elevator device G can be programmed to act with higher working speed and thus ensure extremely high production rate, considerably higher than the production rate obtainable with known solutions.

The above mentioned advantages are obtained by a simple technical solution, which is extremely reliable and functional.

It is understood that what above, has been described as a pure, not limitative example, therefore, possible variants of the invention remain within the protective scope of the present technical solution, as described above and claimed hereinafter.

What is claimed is:

1. An elevator device in a machine for forming packs of rolls, the machine comprising:

a feeding line for feeding rolls;

a conveying line situated above said feeding line for carrying away packs of rolls already formed;

upper constraining means disposed along the conveying line;

holding means of said conveying line, for holding a group of rolls being packed; and an elevator device for taking the rolls from said feeding line to said conveying line, said elevator device having:

an elevation plate made to reciprocate vertically between a lower end position, situated at the level of said feeding line for receiving rolls from said feeding line thus forming a group of rolls on said elevation plate, and an upper end position, defined by positioning a group of rolls on said elevation plate at a level right below said constraining means;

driving means for reciprocating the elevation plate;

a conveying channel for said group of rolls on said elevation plate, said conveying channel leading from said lower end position of said elevation plate up to said upper end position;

means for keeping a wrapping sheet spread crosswise at an intermediate point of said conveying channel, said wrapping sheet partially wrapping said group of rolls on said elevation plate;

an aperture made at a top of said conveying channel;

folding means disposed right above said aperture for folding said wrapping sheet under said group of rolls on said elevation plate when said elevation plate is in said upper end position;

an auxiliary plate member, situated at a lowermost position thereof right above said folding means and below said constraining means, said auxiliary plate member movable vertically between the lowermost position just above said aperture, and an uppermost position in alignment with said upper constraining means of said conveying line, in step relation with elevation of said elevation plate, for firmly holding said group of rolls on said elevation plate engaged therebetween while said group of rolls is passing upward through said aperture, said firm engagement maintained as said group of rolls is moved horizontally into said holding means of said conveying means, and means for vertically moving the auxiliary plate member.

2. An elevator device, as claimed in claim 1, wherein said auxiliary plate member is movable synchronously with said elevation plate.

3. An elevator device, as claimed in claim 1, wherein said vertical moving means is an actuator controlled by the driving means for said elevation plate.

4. An elevator device, as in claim 1, wherein said auxiliary plate member is connected to a spring system, which cooperates therewith by elastic contrast during raising of said group of rolls on said elevation plate with said wrapping sheet.

5. An elevator device, as in claim 1, wherein said upper constraining means include a plate.

6. An elevator device, as in claim 1, wherein said upper constraining means include a plurality of bars.

7. An elevator device, as in claim 1, wherein said holding means of said conveying line move said packs of rolls along said conveying line.

8. And elevator device as in claim 1, wherein said folding means move from an open configuration, in which the outlet of said conveying channel is opened, and a closed configuration for folding said wrapping sheet under said group of rolls on said elevation plate.

* * * * *